United States Patent [19]

Parisien

[11] 3,997,144

[45] Dec. 14, 1976

[54] GATE

[76] Inventor: Rudolph E. Parisien, 891 Rainbow St., Ottawa, Canada

[22] Filed: Feb. 19, 1975

[21] Appl. No.: 551,046

[30] Foreign Application Priority Data

Feb. 21, 1974 Canada ..... 193179

[52] U.S. Cl. ..... 256/32; 160/371; 160/391

[51] Int. Cl.[2] ..... E04H 17/14

[58] Field of Search ..... 256/32; 160/371; 49/381

[56] References Cited

FOREIGN PATENTS OR APPLICATIONS

| | | | |
|---|---|---|---|
| 403,595 | 5/1967 | Australia | 256/32 |
| 1,176,938 | 12/1958 | France | 256/32 |

*Primary Examiner*—Kenneth Downey
*Attorney, Agent, or Firm*—A. W. Breiner

[57] ABSTRACT

A gate or panel including a frame composed of channel members each of which has opposed side walls bent inwardly to define a slot for receiving edges of the chain link fabric which is within the frame. An end link of the fabric, which is in the slot in the adjacent side member, is turned to prevent withdrawal thus securing the fabric to the frame. Each of the frame members has a partition wall extending between the opposed walls so as to stiffen the gate frame. Depending upon the space between the slot and the partition wall it may be necessary to slide the end links into the channel from either end in order to turn the end links rather than inserting the links through the slot from the sides.

2 Claims, 3 Drawing Figures

GATE

This invention relates to fences and more particularly to a gate or panel comprising chain link fencing secured to a frame made of channel members.

Gates or panels constructed of channel members having rectangular cross sections are desireable for aesthetic reasons and are preferred for use with fence rail and posts consisting of rectangular channel members.

It is therefor an object of this invention to provide a gate having an improved appearance due to the fact that the chain link fencing is secured in the channel members and tie wires can also be attached within the channel thereby eliminating the need for wire wrapped around the frame members of the gate. Furthermore elimination of wires wrapped around the frame members of the gate simplifies assembly of the gate.

Accordingly the present invention provides a panel comprising a frame having spaced apart parallel side members, a bottom member and a top member, for supporting chain link fabric, each of the members comprising an elongated channel having opposed side walls an interconnecting wall and a transverse partition wall parallel to the interconnecting wall, each side wall being bent inwardly at its outer side edge to define a slot therebetween adapted to receive an end link of said chain link fabric, said end link having been turned at right angles to the chain link fabric and corner inserts having right angle bends connecting adjacent ends of said frame members whereby end links of the chain link fabric are slid into the slots in the side members from the ends and adjacent ends of the frame members are secured together.

This invention further provides a method of constructing a panel having a frame fabricated of channel members to which chain link fencing is secured, each said channel member having two opposed walls, an interconnecting wall, a partition wall and edges of said walls bent inwardly and toward the partition wall to form J-shaped portions defining a slot therebetween, the method comprising the steps of: assembling a first side member and a bottom member, assembling a second side member and a top member using right angle corner inserts in the free ends of the top and bottom members, sliding an end link of the chain link into a slot in the first side member from the end by disconnecting an end link and turning the link at right angles to the fencing, stretching the fencing toward the second side rail to approximately the width of the gate frame, disconnecting an end link on the other side, turning the link and sliding the link into the slot in the second rail by moving the side rail toward the bottom rail until corner inserts are fully received in the ends of the side rails and fastening the remaining ends of the side rails to the corner inserts.

Figure 1:
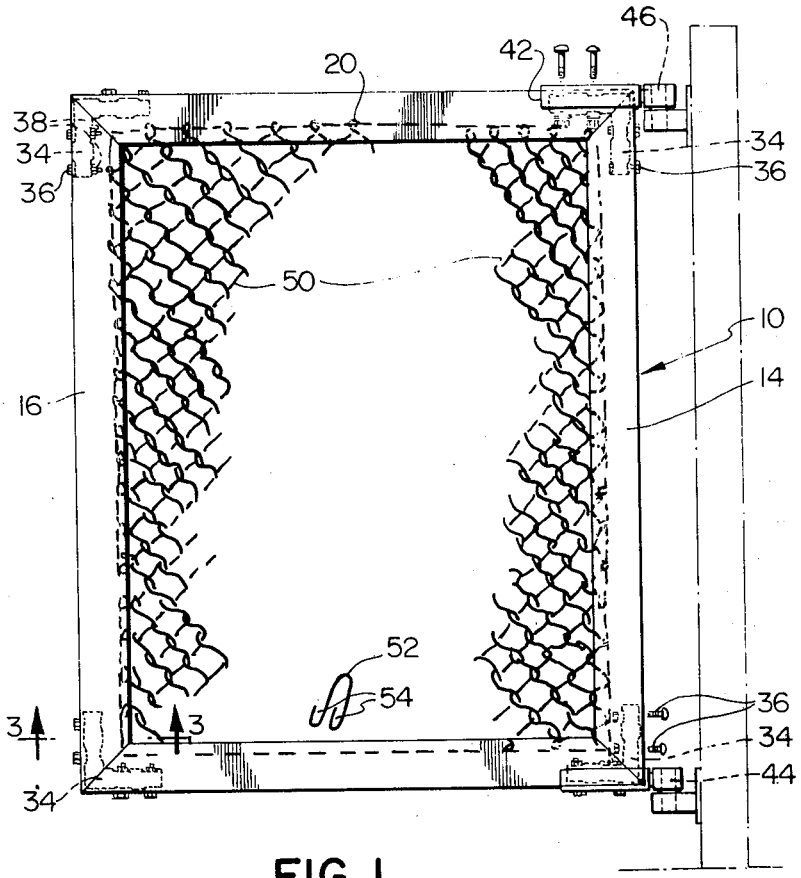
Figure 2:
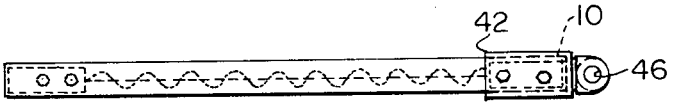
Figure 3:
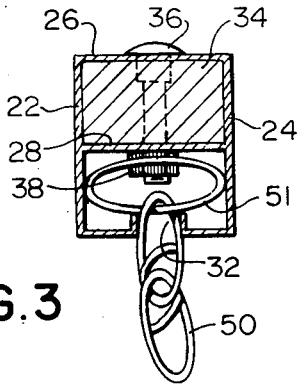

In the accompanying drawings which illustrate embodiments of the invention;

FIG. 1 is an exploded front elevational view of the gate of the present invention, FIG. 2 is an end elevational view of the gate of FIG. 1, and FIG. 3 is a cross section taken along the line 3—3 of FIG. 1.

Referring now in detail to the drawings a gate shown generally at 10 in FIG. 1 includes a frame having parallel side members 14 and 16, a bottom member 18 and a top member 20. The frame members 14,16,18 and 20 comprise channel type members as shown in FIG. 3 having side walls 22 and 24, an interconnecting wall 26 and a partition wall 28. Each of the walls 22 and 24 has its outer side edge bent inwardly to provide a substantially J-shaped cross section and define a slot 32 therebetween. The square tubular section enclosed by the partition wall 28 strengthens the channel member so as to minimize twisting.

As shown in FIG. 1 the ends of the frame members 14, 16, 18 and 20 are mitered and adjacent members are secured together by corner pieces 34 received in the square tubular section between the interconnecting wall 26 and the partition wall 28. Bolts 36 or similar fastening means pass through aligned apertures in the frame members 14, 16, 18 and 20 and nuts 38 are provided on the bolts 36.

The ends of members 18 and 20 adjacent the side members 14 have hinge plates 40 and 42 secured thereto by the bolts 36 which pass through aligned apertures in the plates 40 and 42, the members 18 and 20 and the corner pieces 34. Apertures 44 and 46 in the hinge plates 40 and 42 receive hinge pins (not shown).

A chain link panel 50 is secured to the frame members 14 and 16 by turning an end link 51 of the chain link 50, as shown in FIG. 3 (this requires that the end link 51 be disconnected at top and bottom) and the chain link 50 is then slid into the side members 14 and 16 from the ends.

The top and bottom of the fencing 50 is secured to the members 18 and 20 through the use of wires 52 which are inserted through the mesh of the chain link 50 so that the bent portions 54 engage the J-shaped portions in the channels. The wire is then twisted so as to tighten against the chain link fencing 50. The tie wire 52 is described in my co-pending application Ser. No. 174,105 filed June 14, 1973.

A preferred method of assembling the gate 10 is that of joining the member 14 to the top member 20 and the bottom member 18 to the side member 16. Corner inserts 34 are secured in the free ends of top member 20 and the bottom member 18. The chain link 50 is then slid into the member 14 and the chain link 50 is stretched toward the position of the side member 16. The side member 16 is then slid onto the end link of the chain link 50 and the remaining corner inserts 34 moved into position and secured.

It will be appreciated that although the method of assembly described above is the preferred method it is possible to use a variety of steps such as assembling the side members 14 and 16 and bottom members 18 and sliding the wire mesh into the slots in the frame members from the top.

Similarly, the chain link material can be secured to the side members of the gate by sliding the end links 51 into the slots 32 and then securing the top and bottom members of the frame to the side members using the corner inserts.

Furthermore if the partition wall 28 is positioned or shaped so that there is suficient space within the channel to turn the loop, the end links can be inserted through the slot 32 in the side of the member rather than being slid into the side members 14 and 16 from the top or bottom.

The embodiments of the invention in which an exclusive property or priviledge is claimed are defined as follows:

1. A gate panel comprising a frame and chain link fabric, said frame having spaced apart parallel side members, a bottom member and a top member for supporting said chain link fabric, said parallel side members and said bottom and top members each comprising an elongated channel having opposing side walls, an interconnecting top wall and a transverse partition wall parallel to said interconnecting top wall, each side wall being bent inwardly at its outer side edge to define a slot therebetween, said top and bottom members having the bend in said side walls extended to form portions of substantially J-shaped cross-section to define said slot therebetween; an end link of said chain link fabric being turned at right angles to said chain link fabric for positioning said chain link fabric in the parallel side members of said frame, corner inserts having right angle bends connecting adjacent ends of said frame members together, and hook means for securely attaching said chain link fabric at the top and bottom thereof through the said slots in said top and bottom members and onto said J-shaped cross-section.

2. The gate panel according to claim 1 wherein the side walls of the parallel side members are extended to form portions of substantially J-shaped cross-section to define the slot therebetween.

* * * * *